US005636579A

United States Patent [19]

Shelley

[11] Patent Number: 5,636,579

[45] Date of Patent: Jun. 10, 1997

[54] SECURITY WINDOW ADAPTED TO PREVENT FORCED ENTRY

[75] Inventor: Michael K. Shelley, Greenville, N.C.

[73] Assignee: Protec Company, Greenville, N.C.

[21] Appl. No.: 379,727

[22] Filed: Jan. 27, 1995

[51] Int. Cl.[6] ..... E05G 7/00

[52] U.S. Cl. ..... 109/11; 49/73.1; 49/125; 49/360; 109/12; 109/15; 109/17

[58] Field of Search ..... 109/2, 5, 10–18; 49/73.1, 125, 360; 160/190, 193, 202

[56] References Cited

U.S. PATENT DOCUMENTS

| | | | |
|---|---|---|---|
| 562,712 | 6/1896 | DeLong | 109/17 |
| 774,190 | 11/1904 | Liberty | 109/17 |
| 1,193,908 | 8/1916 | McCloud . | |
| 1,197,317 | 9/1916 | Wexler . | |
| 1,238,704 | 8/1917 | Wendelken | 49/125 |
| 1,258,297 | 3/1918 | Arnold | 109/17 |
| 1,382,803 | 6/1921 | Robbins . | |
| 1,435,038 | 11/1922 | Wood | 109/17 |
| 1,546,848 | 7/1925 | Lundgren | 109/17 |
| 1,623,674 | 4/1927 | Hagestedt . | |
| 1,777,760 | 10/1930 | Murray . | |
| 1,863,680 | 6/1932 | Young et al. . | |
| 1,982,247 | 11/1934 | Foley | 109/17 |
| 2,320,604 | 6/1943 | Jackson et al. | 268/30 |
| 2,908,051 | 10/1959 | Sparkes | 20/19 |
| 2,984,194 | 5/1961 | Jennings | 109/4 |
| 3,067,700 | 12/1962 | O'Meara et al. | 109/12 |
| 4,034,685 | 7/1977 | Word | 109/17 |
| 4,748,914 | 6/1988 | Cardinal | 109/17 |
| 4,826,264 | 5/1989 | Cass | 312/312 |
| 4,831,939 | 5/1989 | Cardinal | 109/17 |
| 4,984,387 | 1/1991 | Wheatland | 49/360 X |

FOREIGN PATENT DOCUMENTS

| | | | |
|---|---|---|---|
| 0276650 | 8/1988 | European Pat. Off. | 109/12 |
| 2397688 | 3/1979 | France | 109/17 |
| 2444459 | 4/1975 | Germany | 109/17 |
| 1176405 | 1/1970 | United Kingdom | 109/12 |

OTHER PUBLICATIONS

Sales Brochure from Protec Company.

*Primary Examiner*—Lloyd A. Gall
*Attorney, Agent, or Firm*—Richard E. Jenkins, P.A.

[57] ABSTRACT

A security window having one or more vertically movable panels, suitably of a transparent, rigid plastic that is bullet-resistant. The security window is useful for a clerk in a convenience store. The security window is provided with a safety mechanism that is operatively associated with the one or more vertically movable panels, and prevents direct vertical manual movement thereof by a would-be robber.

20 Claims, 9 Drawing Sheets

SECURITY WINDOW ADAPTED TO PREVENT FORCED ENTRY

TECHNICAL FIELD

The present invention relates generally to a novel security window, particularly useful for a module, kiosk, or portion of a wall, in order to protect a clerk on one side of the window from a robber on the other side of the window. More particularly, the present invention relates to such a novel security window that has one or more vertically movable panels, and a safety mechanism, whereby direct vertical manual movement of the movable panel(s) is prevented, whether the window is completely open, partially opened or closed, or completely closed.

RELATED ART

There are many devices in the prior art for moving a door or window panel. Such panels are used, for instance, in a sliding door (connecting a house to a patio), a bank teller's security cage, a garage, and an elevator.

In general, the prior devices relating to security cages for bank clerks have one moving panel that closes "instantaneously", i.e., extremely quickly in about 0.5 second or less. Thus, the cage is useful for the emergency situation when a robber is confronting the clerk. Since the cage is not kept closed during the work day as transactions take place between the clerk and legitimate customers, there is no necessity for the panel to be made of a transparent, bullet-resistant plastic or glass window, and the panel typically is an opaque steel shield.

However, over the last decade or so, the need has been increasing for a security enclosure for night shift clerks in a business that stays open 24 hours per day, for instance, a small grocery store (colloquially known as a "convenience store"), a hotel, or a motel, since the majority of robberies at such businesses occur during the nighttime. For these businesses, there is a need for a transparent panel that can be closed within several seconds, for instance about 7 to 10 seconds, so that the clerk will be able to choose when to close the panel to be secure during the nighttime, and yet have the ability to see and to perform transactions with legitimate customers who come into the business during the nighttime. During the daytime when the risk of robberies is less, the panel can be left open to promote a friendly atmosphere. In other words, the need for security provided by a movable panel that closes instantaneously when a bank clerk is confronted by a robber during regular, daytime working hours differs from the need for security for the clerk in a business open all night long.

An example of a security window useful in a business that is open 24 hours per day is described in a sales and advertising brochure entitled "If the Thought of This Scares You . . . " from Protec Company of Greenville, N.C. Illustrated in this brochure is Protec's SECURE-SELL™ brand of an electrically operated retractable ballistic barrier security window, which is shown disposed in a module situated inside of a convenience store. As can be seen in the brochure, when the module is in an open position, its one moveable panel is in the countertop. Then, activation of a battery operated electric motor causes upward movement of the one moveable panel toward the roof of the module in order to close the module. Because of this feature, a transaction tray for the clerk and the customer to pass money and goods back and forth obviously cannot be placed in the portion of the countertop in which the panel moves. Accordingly, the module may be provided with one or more additional transparent, bullet-resistant, stationary panels in line with and on either or both sides of the opening for the one movable panel so that there is a transaction device disposed in or on the countertop underneath each one of these stationary panels.

Additionally, of interest is U.S. Pat. No. 4,034,685, issued in 1977 to Word. This patent is directed to a bank teller's security closure having a vertically extending shield mounted relative to a teller's cage and adapted to be moved from an open, top position to a bottom, closed position so that access to the teller's cage, such as by a potential robber, is unobtainable. The moving shield may be constructed of bullet-proof glass, and is moved downwardly to the closed position by two cables, one disposed in each side channel of the cage. Each cable is wound around an upper and lower pulley. Besides an electrical activating means, the teller's shield has a manual activating means that is capable of operating upon failure of electrical power so that the shield may be lowered to the closed position, in the event of a power failure or the event of a robber disconnecting the power.

Of some relevance are U.S. Pat. No. 1,777,760, issued in 1930 to Murray, and U.S. Pat. No. 4,826,264, issued in 1989 to Cass, both of which involve a security closure for a bank teller's cage. However, in contrast to the device in the patent to Word, the devices in these two patents involve multiple-panel, steel shutters that have lips on their edges for the purpose of interlinking and uniting them in a shingled relationship when the teller's cage is closed. In the patent to Murray, the steel panels move downwardly from an upper position to a lower position for the cage to be closed, whereas in the patent to Cass, the steel panels rise upwardly from a lower position to an upper position for the cage to be closed.

Somewhat similar is U.S. Pat. No. 2,908,051, issued in 1959 to Sparkes, which shows a window assembly having a plurality of window panels in shingled relationship, with the uppermost panel fixed at the top of the assembly. The remainder of the panels are vertically slidable. When the window is open, the panels are evenly stacked in superposed formation. As the slidable panels move from the open, top position, each succeeding movable panel is free to move downwardly from the top throughout its separate path independently of the immediately preceding panel to effect closure of the window. Moreover, like the steel panels in the above-mentioned patent to Murray and patent to Cass, the panels in the patent to Sparkes have lips on their edges so that the panels interlock by engaging respective edges as the panels move downwardly from the open, top position to the closed position. The panels are suitably manufactured from a lightweight plastic.

Also, of background interest is U.S. Pat. No. 2,320,604, issued in 1943 to Jackson et al., which shows two or more telescoping door panels that can be lowered from the ceiling to the floor vis-a-vis a plurality of pulleys secured equidistantly along a shaft, each pulley being provided with a lifting cable. The bottom ends of the lifting cables are attached to the top edges of the panel, and each cable has a pair of cylinders and pistons to equalize tension so that each panel can be operated evenly. The telescoping door panels are useful in aircraft hangers.

A number of other devices, illustrated in U.S. Pat. No. 1,193,908, issued in 1916 to McCloud; U.S. Pat. No. 1,197,317, issued in 1916 to Wexler; U.S. Pat. No. 1,258,297, issued in 1918 to Arnold; U.S. Pat. No. 1,382,803, issued in 1921 to Robbins et al.; U.S. Pat. No. 1,623,674, issued in 1927 to Hagestedt; U.S. Pat. No. 1,863,680, issued in 1932 to Young et al.; U.S. Pat. No. 2,984,194, issued in 1961 to Jennings; and U.S. Pat. No. 3,067,700, issued in 1962 to O'Meara et al. are also of some background interest vis-a-vis movable panels.

SUMMARY AND OBJECTS OF THE INVENTION

Therefore, the present invention provides a security window comprising a frame, a vertically extending fixed panel, a vertically extending movable panel assemblage, a counterbalancing mechanism, a mounting mechanism, an activator, and a safety mechanism.

The frame has a roof member, a first side member, and a second side member. Also, the vertically extending fixed panel is fixedly mounted adjacent to the roof member, and the fixed panel has a top edge, a bottom edge, a first side edge, and a second side edge.

The vertically extending movable panel assemblage comprises at least one movable panel slidably mounted in the frame and adapted to be vertically moved between an upper opened position and a lower closed position. The movable panel has a top edge, a bottom edge, a first side edge, and a second side edge. The counterbalancing mechanism for the movable panel assemblage includes a primary counterweight.

The mounting mechanism is operatively associated with the frame to permit vertical movement of the movable panel in a path that defines a plane substantially parallel to the plane defined by the fixed panel. The mounting mechanism preferably includes a first shaft, a first and a second sprocket, and a first and a second chain. The first shaft has a first end and a second end. The first shaft is operatively associated with the first movable panel, and is supported for rotational movement adjacent the roof member of the frame. The first and the second sprockets are disposed, respectively, at the first and the second ends of the first shaft. The first and the second chains are (i) connected, respectively, to the first and the second side edges of the movable panel, and (ii) connected to the primary counterweight, and (iii) wound, respectively, over the first and the second sprockets.

The activator is operatively associated with the movable panel assemblage, such that engagement of the activator allows for vertical movement thereof, and the safety mechanism is operatively associated with the movable panel assemblage and adapted to prevent direct vertical manual movement thereof.

Accordingly, it is an object of the present invention to provide a security window having one or more vertically moveable panels that can be moved downwardly to close the window and protect a user from a robber.

It is another object of the present invention to provide a security window that protects a user in that the window has a safety mechanism that will not allow for direct vertical manual movement of the moveable panel(s) of the window by a person, whether the security window is completely opened, partially opened or partially closed, or completely closed.

Thus, it is a feature of the present invention that when the security window is closed, a robber attempting direct vertical manual movement of the moveable panel(s) will not be able to move them and open the security window.

Some of the objects of the invention having been stated above, other objects will become evident as the description proceeds, when taken in connection with the accompanying drawings as best described below.

DETAILED DESCRIPTION OF THE INVENTION

The discussion below is of the preferred embodiment of the invention as illustrated in FIGS. 1–9. The same numerals are used to depict the same elements in the different FIGS. 1–9.

Figure 1:
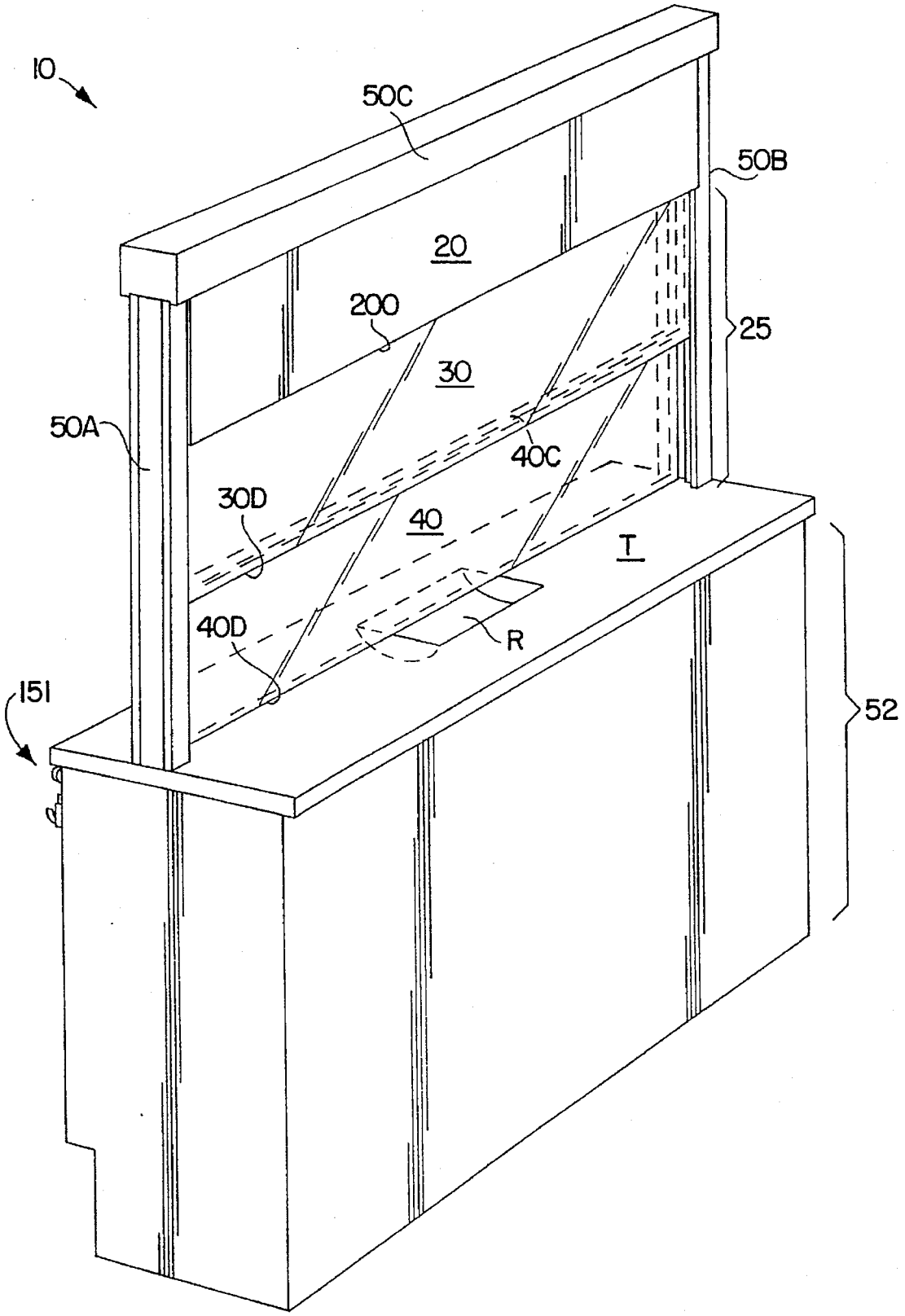
FIG. 1 is a front perspective view of the novel security window of the present invention.
Figure 2:
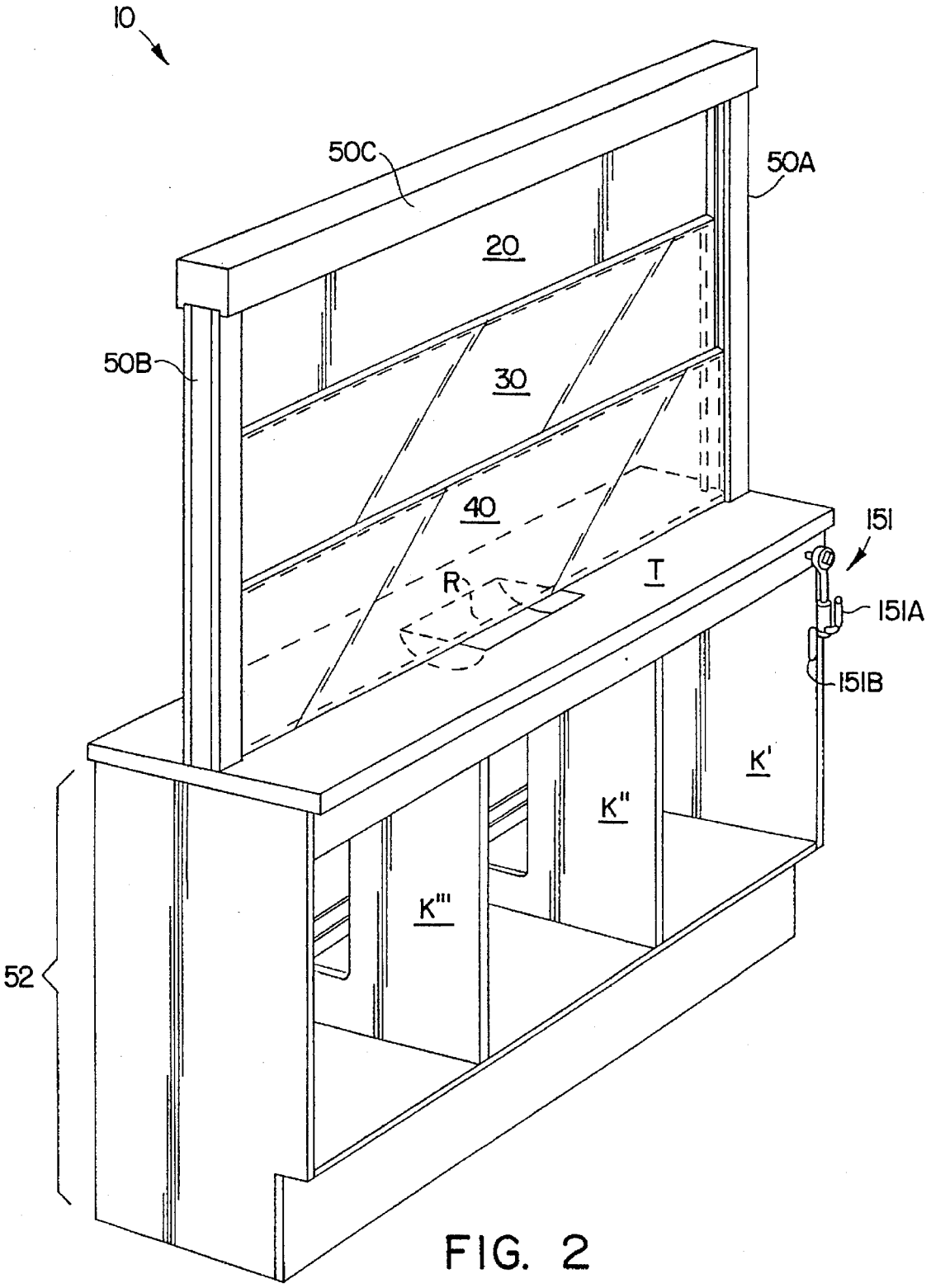
FIG. 2 is a rear perspective view of the novel security window of FIG. 1.

More particularly, illustrated in FIG. 1 is a front perspective view of the inventive security window 18 in its closed position. FIG. 2 is similar to FIG. 1, except that FIG. 2 is a rear perspective view of security window 10.

Security window 10 has a transom or fixed panel 20 and a moveable panel assemblage 25. Moveable panel assemblage 25 comprises a first movable panel 30 and a second movable panel 40. As discussed in more detail below, the panels of assemblage 25 are adapted to move vertically downward from an upper open position to a lower closed position, and vice versa.

It is noted that although security window 10 is shown in its preferred embodiment with two moveable panels 30 and 40, it is contemplated that security window 10 may have one moveable panel or may have three or more moveable panels as a matter of design choice.

Fixed panel 20 has a first side edge 20A, a second side edge 20B, a top edge 20C, and a bottom edge 20D. Likewise, first moveable panel 30 has a first side edge 30A, a second side edge 30B, a top edge 30C, and a bottom edge 30D, and second moveable panel 40 has a first side edge 40A, a second side edge 40B, a top edge 40C, and a bottom edge 40D.

Panels 20, 30, and 40 are most suitably positioned within a frame or framework 50, which has a first side member 50A, a second side member 50B, and a roof member 50C. Suitably, framework 50 is mounted on a countertop T of cabinet 52 having a recess R disposed therein. Recess R is illustrated as a transaction tray for passing items, particularly money, back and forth between a customer at the front to a clerk at the back of security window 10 when window 10 is in its closed position. Since moveable panels 30 and 48 move in a downward direction to close window 10, as is further discussed below, recess R can be conveniently located directly beneath panels 20, 30, and 40. It is noted that recess R should be small so as not to allow room for a robber to slide his/her hand holding a gun under panels 30 and 40 when window 10 is in its closed position.

Furthermore, as can be seen in FIG. 2, optional storage compartments K', K", and K'" may be disposed beneath countertop T. Compartments K', K", and K'" are shown open to the back of cabinet 52 for a clerk working behind security window 10 to store items. Of course, depending on what is desired for the clerk, the compartments may have doors, and also more or fewer compartments, as well as compartments opening to the front of cabinet 52 to display items for purchase by a customer, may be provided.

During use, security window 10 may be a part of a wall of a room of a business, a module that sits upon the floor of a room of a business, or a combination thereof, in order to provide an enclosure for a user thereof, for instance, a clerk in a convenience store.

Panels 20, 30, and 40 and cabinet 52 should be bullet-resistant to afford protection to the clerk from a robber who has a gun. To provide such bullet-resistant characteristics to security window 10, cabinet 52 is lined with steel and each of panels 20, 30, and 40 is manufactured from a transparent material selected from bullet-resistant glass, bullet-resistant rigid plastic, or a combination thereof. The transparent material allows the clerk and customer to view each other therethrough when window 10 is in its closed position.

Preferable bullet-resistant rigid plastic for the panels may be purchased under the registered trademark LUCITE® S-A-R II from ICI or DuPont. A bullet-resistant rigid plastic sold under the registered trademark LEXGARD® from General Electric also may be employed, but this material is not as rigid as LUCITE® S-A-R II. Thus, there is a possibility that a strong robber using a crowbar can horizontally pry apart two LEXGARD® panels, which is extremely difficult to do to two LUCITE® S-A-R-II panels. To avoid this possibility if using LEXGARD® panels, the panels should have a metal border (not illustrated) around the edges thereof. However, such a border can interfere with the clerk and customer easily viewing each other when security window 10 is in its closed position.

Various sizes for security window 10 may be employed. The only requirements are that security window 10 be of an appropriate size to fit into the room of the business where it will be placed, and that the height of panels 20, 30, and 40 and the height of cabinet 52 are appropriate for average sized persons. For instance, when security window 10 is in the form of a module (not shown), the module will generally be a box-like shape about 5 to 10 feet (about 152 to 305 cm) deep, about 8 to 30 feet (about 487 to 549 cm) wide, and about 7.5 to 9 feet (about 229 to 274 cm) tall to allow at least one clerk sufficient room to move about when working inside the module and behind countertop T.

A typical size for each of panels 20, 30, and 40 is about 20 inches (about 51 cm) in vertical height, about 8 feet (about 244 cm) in horizontal length, and about 1.25 inches (about 3.2 cm) in thickness, and a typical weight is about 110 pounds (about 242 kg). From the top of roof member 50C to the bottom of cabinet 52 is generally about 8 feet (about 244 cm) in vertical height, and cabinet 52 is usually about 40 inches (about 101 cm) in vertical height with countertop T being about 30 inches (about 76 cm) deep.

However, if one movable panel is used instead of two, then generally the one movable panel will be about twice the 20 inches (51 cm) of vertical height and twice the 110 pound (242 kg) weight of either first movable panel 30 or second movable panel 40. In that situation, more space would be needed to move the one movable panel upwardly so that security window 10 would be in its open position, and hence, security window 10 would typically be at least about 9 feet (about 274 cm) from the top of roof member 50C to the bottom of cabinet 52.

Figure 3:
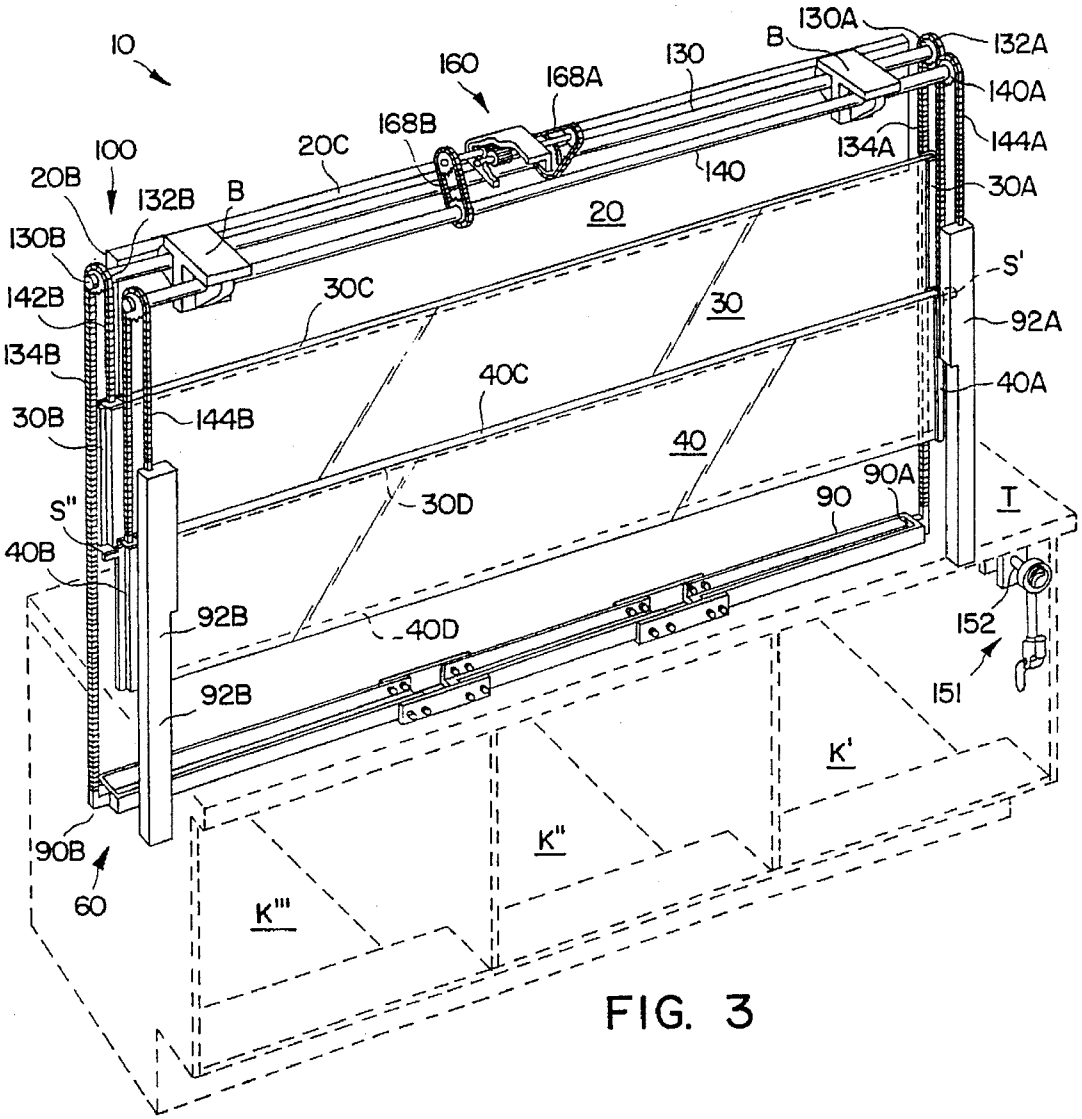
FIG. 3 a rear perspective view of the security window of FIG. 2, but showing the working mechanism in solid lines and the associated counter in phantom lines for better clarity of understanding.

FIG. 3 is a view of security window 10 illustrating greater detail thereof than FIGS. 1 and 2 illustrate. For convenience in showing the greater detail, FIG. 3 does not show recess R.

More specifically with regard to FIG. 3, transom or fixed panel 20 is fixedly mounted at each side 20A, 20B to first side member 50A and second side member 50B, respectively, of frame 50. Additionally, each of first edge 30A and second edge 30B of first movable panel 30 is slidably mounted, respectively, in first side member 50A and second side member 50B of frame 50, and similarly, each of first edge 40A and second edge 40B of second movable panel 40 is slidably mounted, respectively, in first side member 50A and second side member 50B of frame 50.

Figure 4A:
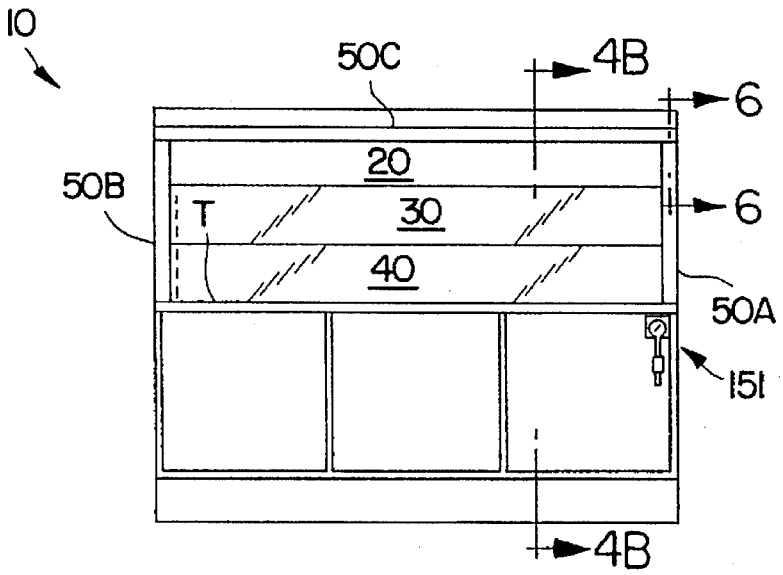
FIG. 4A is a rear elevational view of the security window of FIG. 2, with the panels in the closed position.
Figure 4B:
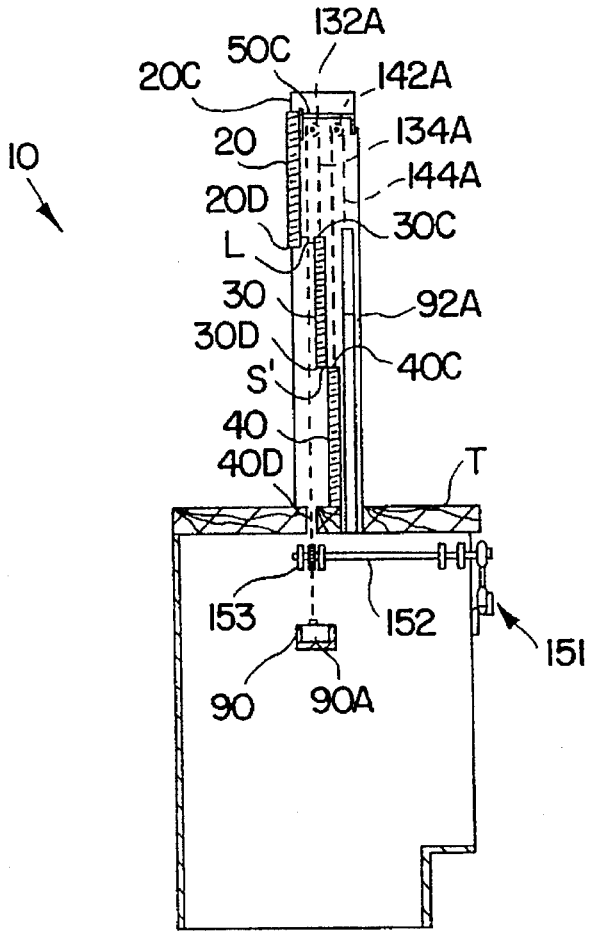
FIG. 4B is a vertical cross-sectional view taken along the line 4B—4B of FIG. 4A.
Figure 5A:
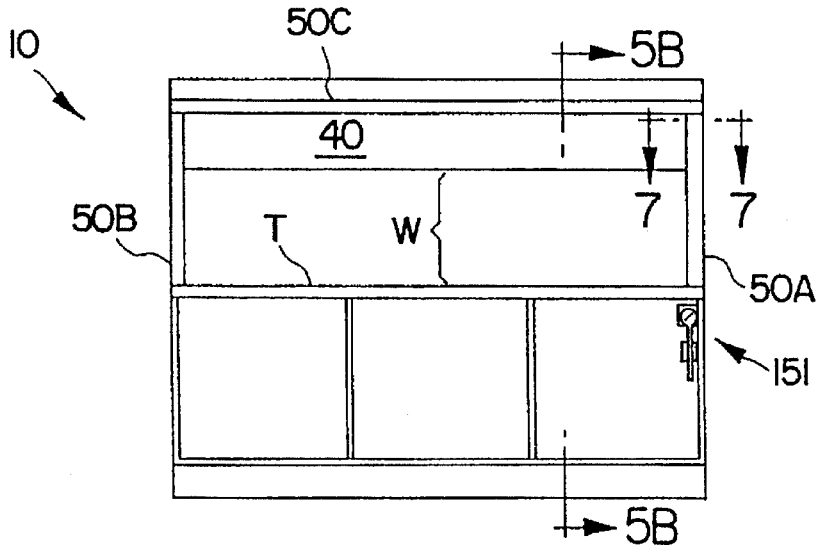
FIG. 5A is a rear elevational view of the security window of FIG. 2, but with the panels in the open position.
Figure 5B:
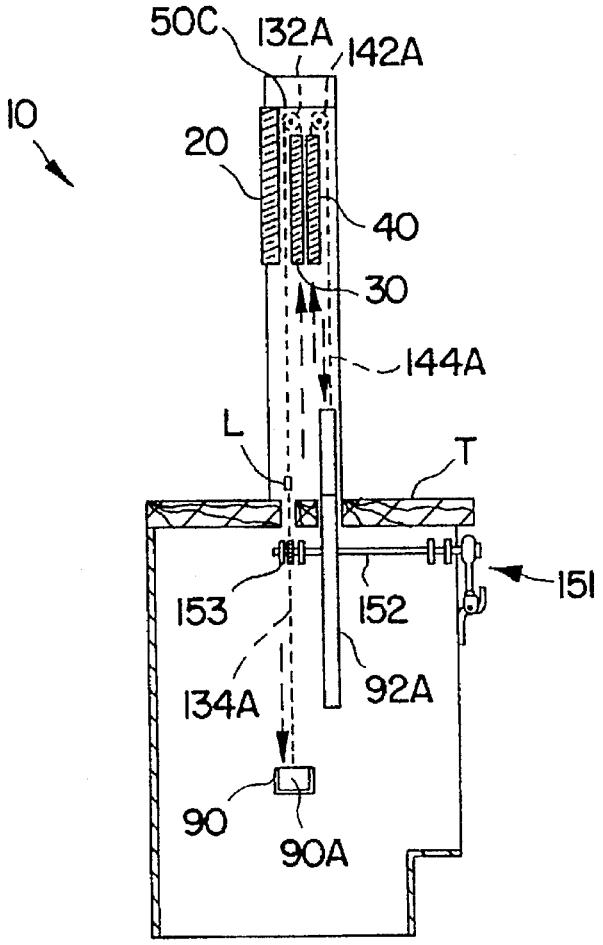
FIG. 5B is a vertical cross-sectional view taken along the line 5B—5B of FIG. 5A.

As a result, first and second movable panels 30, 40 are adapted to be vertically moved between a lower fully closed position (see FIGS. 4A and 4B) and an upper fully opened position (see FIGS. 5A and 5B). Movable panels 30, 40 can be moved vertically up or down, so that window 10 is fully open, partially opened or closed, or fully closed. First movable panel 30 and second movable panel 40 each vertically move in a path defining a plane substantially parallel to the plane defined by fixed panel 20, and movement downwardly from the upper fully opened position to the lower fully closed position, or vice versa, takes about 5 to 7 seconds.

A counter balancing mechanism 60 is provided for each of the one or more movable panels, and includes a primary counterweight 90 for first moveable panel 30. Primary counterweight 90 has a first end 90A and a second end 90B, and is horizontally disposed in cabinet 52. For second moveable panel 40, counter balancing mechanism 60 may further include a secondary counterweight comprising two equally sized first and second counterweights 92A and 92B vertically disposed, respectively, in each of first side member 50A and second side member 50B of frame 50. By "equally sized", it is meant that first and second equally sized counterweights 92A and 92B are generally of the same shape and same weight.

A mounting mechanism 100 is operatively associated with frame 50 to permit vertical movement of the one or more movable panels, each in a path defining a plane substantially parallel to the plane defined by fixed panel 20. Thus, mounting mechanism 100 includes a first shaft 130, a first and a second sprocket member 132A and 132B, and a first and a second chain 134A and 134B for first movable panel 30. Chain 134A is connected to shaft 152 of ratchet 151 in a conventional manner to be described in more detail below (see FIG. 4B). Ratchet 151 may be mounted on either side of window 10 as a matter of design choice.

First shaft 130 has a first end 130A and a second end 130B, and is operatively associated with first movable panel 30. First shaft 130 is supported for rotational movement adjacent roof member 50C in mounting blocks B.

First sprocket 132A and second sprocket 132B are disposed, respectively, at first end 130A and second end 130B of first shaft 130. Also, first sprocket 132A and second sprocket 132B have wound thereover, respectively, first chain 134A and second chain 134B. First chain 134A and second chain 134B are connected, respectively, to first side edge 30A and second side edge 30B of first movable panel 30, and, respectively, to first end 90A and second end 90B of primary horizontally disposed counterweight 90.

For second movable panel 40, mounting mechanism 100 includes a second shaft 140, a third and a fourth sprocket 142A and 142B, and a third and a fourth chain 144A and 144B.

Second shaft 140 has a first end 140A and a second end 140B, and is operatively associated with second movable panel 40. Second shaft 140 is supported for rotational movement adjacent roof member 50C in mounting blocks B.

Third sprocket 142A and fourth sprocket 142B are disposed, respectively, at first end 140A and second end 140B of second shaft 140. Third sprocket 142A and fourth sprocket 142B have wound thereover, respectively, third chain 144A and fourth chain 144B. Additionally, third chain 144A and fourth chain 144B are connected, respectively, to first side edge 40A and second side edge of 40B of second movable panel 40, and, respectively, to vertically disposed first and second equally sized counterweights 92A and 92B.

In the preferred embodiment with first and second movable panels 30 and 40, first and second shafts 130 and 140 are operatively connected by a gear mechanism 160. Gear mechanism 160 is shown in FIG. 3 to facilitate understanding the location thereof, but discussed below in more detail in connection with FIG. 8.

Moreover, positions of the various panels and counterweights can be better seen with reference to FIGS. 4A and 4B (security window be is closed) and FIGS. 5A and 5B (security window be is open).

More particularly, FIG. 4A is a rear elevational view of security window 10, and FIG. 4B is a cross-sectional view thereof taken along the line 4B—4B of FIG. 4A. FIGS. 4A and 4B show movable panels 30, 40 in the closed position.

As can be seen, fixed panel 20, first movable panel 30, and second movable panel 40, are all in imbricated relationship. Suitably, bottom edge 20D of fixed panel 20 and top edge 30A of first movable panel 30 overlap about 1 to 2 inches (about 2.5 to 5 cm), and likewise bottom edge 30D of first movable panel 30 and top edge 40A of second movable panel 40 overlap about 1 to 2 inches (about 2.5 to 5 cm), when movable panels 30, 40 are in the closed position. These overlapping portions may touch; however, it is preferred that they are spaced apart about 0.25 inch (about 0.635 cm) to about 0.50 inch (about 1.27 cm) so that when security window 10 is closed, the clerk and customers may converse without the necessity for an intercom system. The spacing apart should not be large enough to allow a robber to insert a gun therethrough.

When first movable panel 30 and second movable panel 40 are moved downwardly to their respective lower positions to place security window 10 in the closed position, as is illustrated in FIG. 4B, portions of bottom edge 30D of first movable panel 30 will come to rest on first and second stops S', S" (see FIG. 3) disposed, respectively, in first side member 50A and second side member 50B approximately midway between countertop T and bottom edge 20D of fixed panel 20. As a result, first movable panel 30 is approximately midway between fixed panel 20 and second movable panel 40. However, second movable panel 40 moves all the way down to countertop T so that bottom edge 40D of second movable panel 40 contacts countertop T.

Figure 4C:
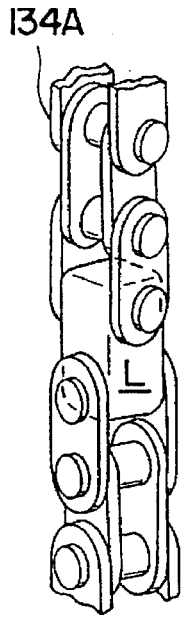
FIG. 4C is an enlarged, perspective view of the linkage element in FIG. 4B.

FIG. 4C provides an enlarged, perspective view of chain 134A which is provided with a linkage element L that allows for turning of the chain by 90 degrees. If desired, similar linkage elements L (not illustrated) may be provided for 90 degree turning of other chains 134B, 144A, and 144B.

FIG. 5A is a rear elevational view of security window 10, and FIG. 5B is a cross-sectional view thereof taken along the line 5B—5B of FIG. 5A. FIGS. 5A and 5B illustrate movable panels 30, 40 of security window 10 in the opened position.

As can be seen, fixed panel 20, first movable panel 30, and second movable panel 40 are in substantially parallel relationship, and respective bottom edges 20D, 30D, and 40D are generally aligned, leaving open space W. Typically, bottom edges 20D, 30D, and 40D will be about 36 inches (about 91 cm) above counter top T, which will allow for ease of conversing between the clerk and the customer generally without the need for looking through portions of panels 20, 30, and 40 when security window 10 is opened.

The following is noted with regard to the positions of the counterweights, when comparing FIGS. 4B and 5B. More specifically, when security window 10 is in its closed position, as illustrated in FIG. 4B, counterweight 90, which is associated with first movable panel 30, is in its uppermost position, suitably about 6 inches (about 15 cm) below counter top T. Additionally, counterweights 92A and 92B (see FIG. 3), which are associated with second movable panel 40, are also in their uppermost position, suitably with a portion thereof above countertop T and a portion thereof beneath countertop T. Typically, most of each of counterweights 92A and 92B will be above countertop T.

On the other hand, when security window 10 is in its opened position as illustrated in FIG. 5B, then counterweight 90, which is associated with first movable panel 30, is in its lowermost position, typically about 24 inches (about 46 cm) beneath countertop T, thereby leaving about 10–12 inches (about 56 cm) underneath counterweight 90 for wiring or other construction (not illustrated). Likewise, counterweights 92A, 92B (see FIG. 3), which are associated with second movable panel 40, are in their lowermost position so as to leave about 6 inches (about 15 cm) thereunder for any wiring or other construction (not illustrated).

Lastly in connection with FIGS. 4B and 5B, an activator 151 is illustrated as operatively associated moveable panels 30 and 40 of assemblage 25, such that engagement of activator 151 allows for vertical movement thereof. Activator 151 is conventionally illustrated as a ratchet having an associated shaft 152 and sprocket 153 which engages chain 134A. Although activator 151 is illustrated as a ratchet for manual movement of assemblage 25, activator 151 may also be an electric motor for movement, or a combination thereof as a matter of design choice. If an electric motor is used, it should be battery operated (and the battery continually recharged) in the event a robber disconnects the electricity supplied to the business wherein security window 10 is located.

Figure 6:
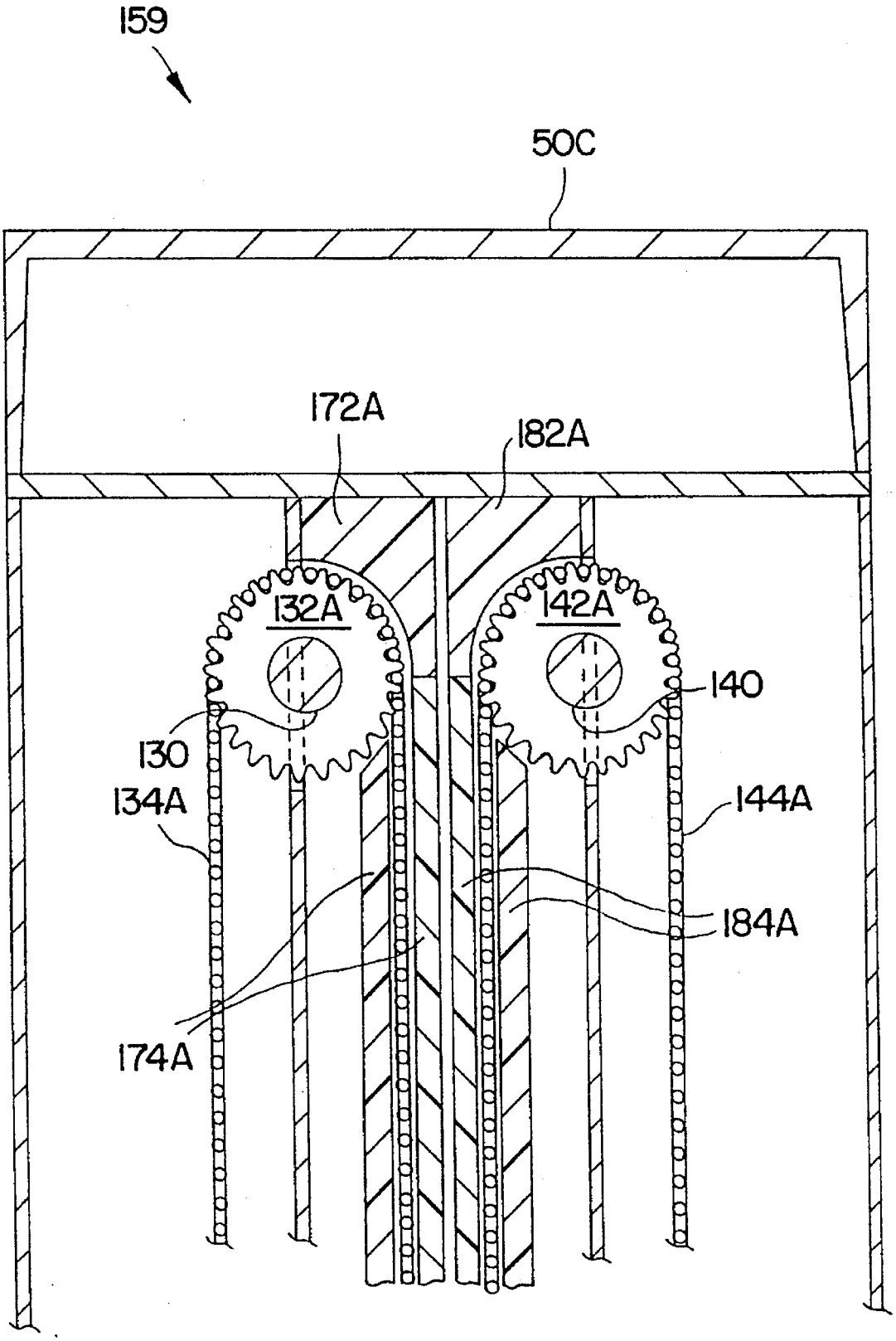
FIG. 6 is an enlarged vertical cross-sectional view taken along the line 6—6 of FIG. 4A to illustrate better the shaped block associated with each sprocket and the channel associated with each chain.
Figure 7:
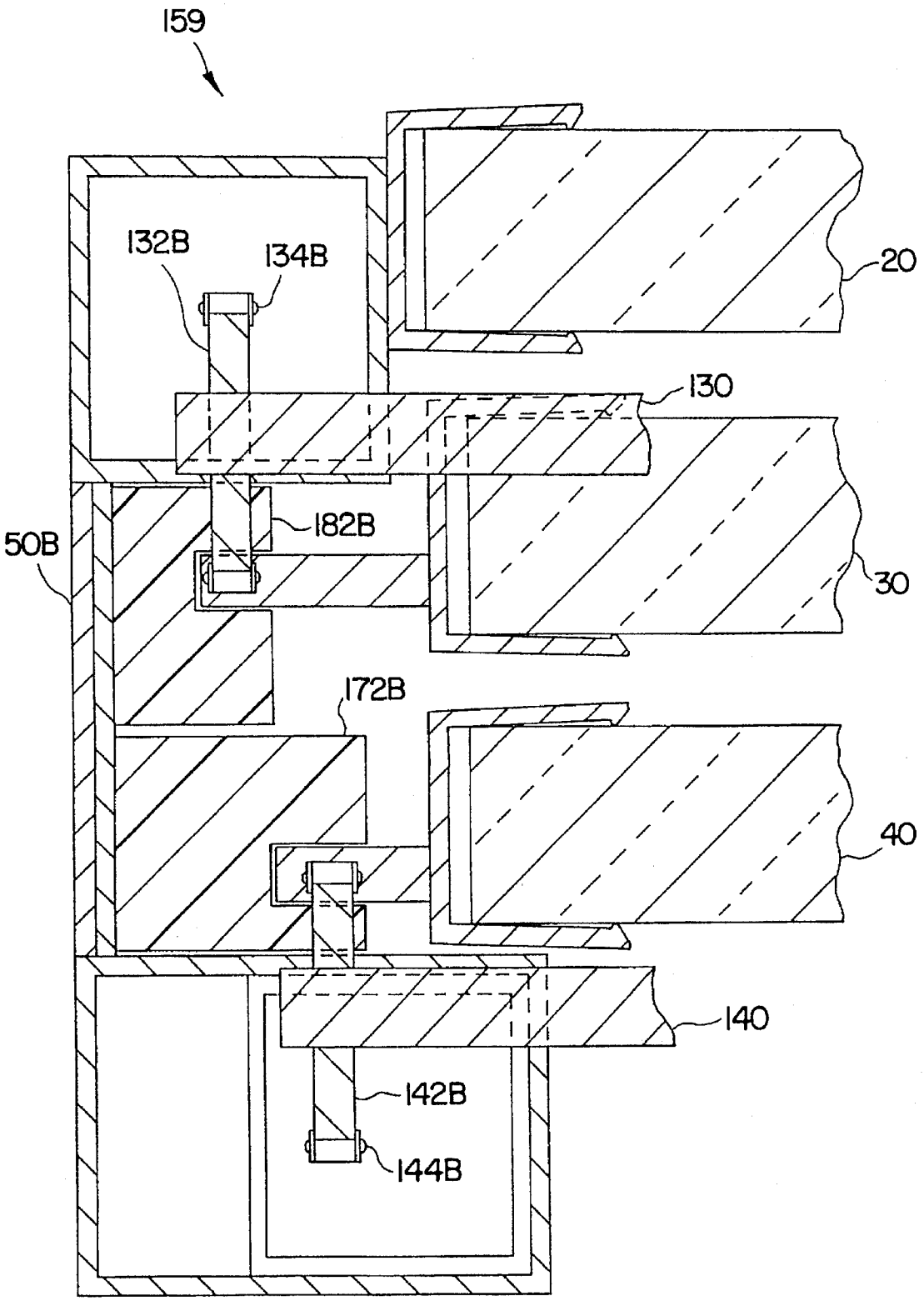
FIG. 7 is an enlarged horizontal cross-sectional view taken along the line 7—7 of FIG. 5A also to illustrate better the shaped block associated with each sprocket and the channel associated with each chain.

Referring now to FIGS. 6 and 7, it is noted that FIG. 6 is an enlarged vertical cross-sectional view taken along the line 6—6 of FIG. 4A, and FIG. 7 is an enlarged, cross-sectional view taken along the line 7—7 of FIG. 5A. It is noted that FIGS. 6 and 7 illustrate elements in or adjacent first side member 50A of frame 50. The elements of the opposing second side member 50B of frame 50 are identical to those shown in FIGS. 6 and 7 and thus not illustrated herein.

Illustrated in FIGS. 6 and 7 is a safety mechanism 159 which is operatively associated with the movable panels and adapted to prevent direct vertical manual movement thereof. In the preferred embodiment (see FIG. 8), safety mechanism 159 also includes gear mechanism 160 and ratchet 151 (see FIG. 9).

By "direct vertical manual movement" is meant movement vertically up and/or down of the one or more moveable panels by a person, such as a robber, placing hands, a club, or the like directly in contact with one or more of the moveable panels in an attempt to move them up and/or down, as opposed to movement thereof vis-a-vis the above-described activator 151 and mounting mechanism 100. Therefore, when security window 10 is closed, safety mechanism 159 will not allow for direct vertical manual movement upwardly of the moveable panels by a robber trying to open security window 10.

For clarity in explaining safety mechanism 159, it is first reiterated that first shaft 130, first and second sprockets 132A and 132B, and first and second chains 134A and 134B are associated with first movable panel 30.

Safety mechanism 159 includes a first arcuate-shaped block 172A associated with first sprocket 132A and a first channel 174A associated with first chain 134A, and correspondingly, a second arcuate-shaped block 172B associated with second sprocket 132B and a second channel 174B associated with second chain 134B.

More particularly, first arcuate-shaped block 172A is disposed in first side member 50A and positioned near roof member 50C and above first sprocket 132A to prevent first chain 134A from being lifted off its respective first sprocket 132A during attempted direct rapid vertical manual movement of first movable panel 30. Likewise, second arcuate-shaped block 172B is disposed in second side member 50B and positioned near roof member 50C and above second sprocket 132B to prevent second chain 134B from being lifted off its respective second sprocket 132B during attempted direct rapid vertical manual movement of first movable panel 30.

First channel 174A is disposed in first side member 50A, and first channel 174A is dimensioned to permit respective travel therein of first chain 134A but to prevent first chain 134A from buckling during attempted direct vertical manual movement of first movable panel 30. Likewise, second channel 174B is disposed in second side member 50B, and second channel 174B is dimensioned to permit respective travel therein of second chain 134B but to prevent second chain 134B from buckling during attempted direct vertical manual movement of first movable panel 30.

Also, with respect to second movable panel 40 in the preferred embodiment of security window 10, the following are provided for safety mechanism 159. For clarity in explaining the preferred embodiment, it is reiterated that second shaft 140, third and fourth sprockets 142A and 142B, and third and fourth chains 144A and 144B are associated with second movable panel 40.

For the preferred embodiment with second movable panel 40, safety mechanism 159 also includes a third arcuate-shaped block 182A, a fourth arcuate-shaped block 182B, a third channel 184A, and a fourth channel 184B.

More particularly, third arcuate-shaped block 182A is disposed in first side member 50A, and positioned near roof member 50C and above third sprocket 142A to prevent third chain 144A from being lifted off its respective third sprocket 142A during attempted direct vertical manual movement of second movable panel 40. Likewise, fourth arcuate-shaped block 182B is disposed in second side member 50B, and positioned near roof member 50C and above fourth sprocket 142B to prevent fourth chain 144B from being lifted off its respective fourth sprocket 142B during attempted direct vertical manual movement of second movable panel 40.

Third channel 184A is provided for third chain 144A, with third channel 184A being disposed in first side member 50A. Third channel 184A is dimensioned to permit respective travel therein of third chain 144A but to prevent third chain 144A from buckling during attempted direct vertical manual movement of second movable panel 40. Likewise, fourth channel 184B is provided for fourth chain 144B, with fourth channel 184B being disposed in second side member 50B. Fourth channel 184B is dimensioned to permit respective travel therein of fourth chain 144B but to prevent fourth chain 144B from buckling during attempted direct vertical manual movement of second movable panel 40.

Figure 8:
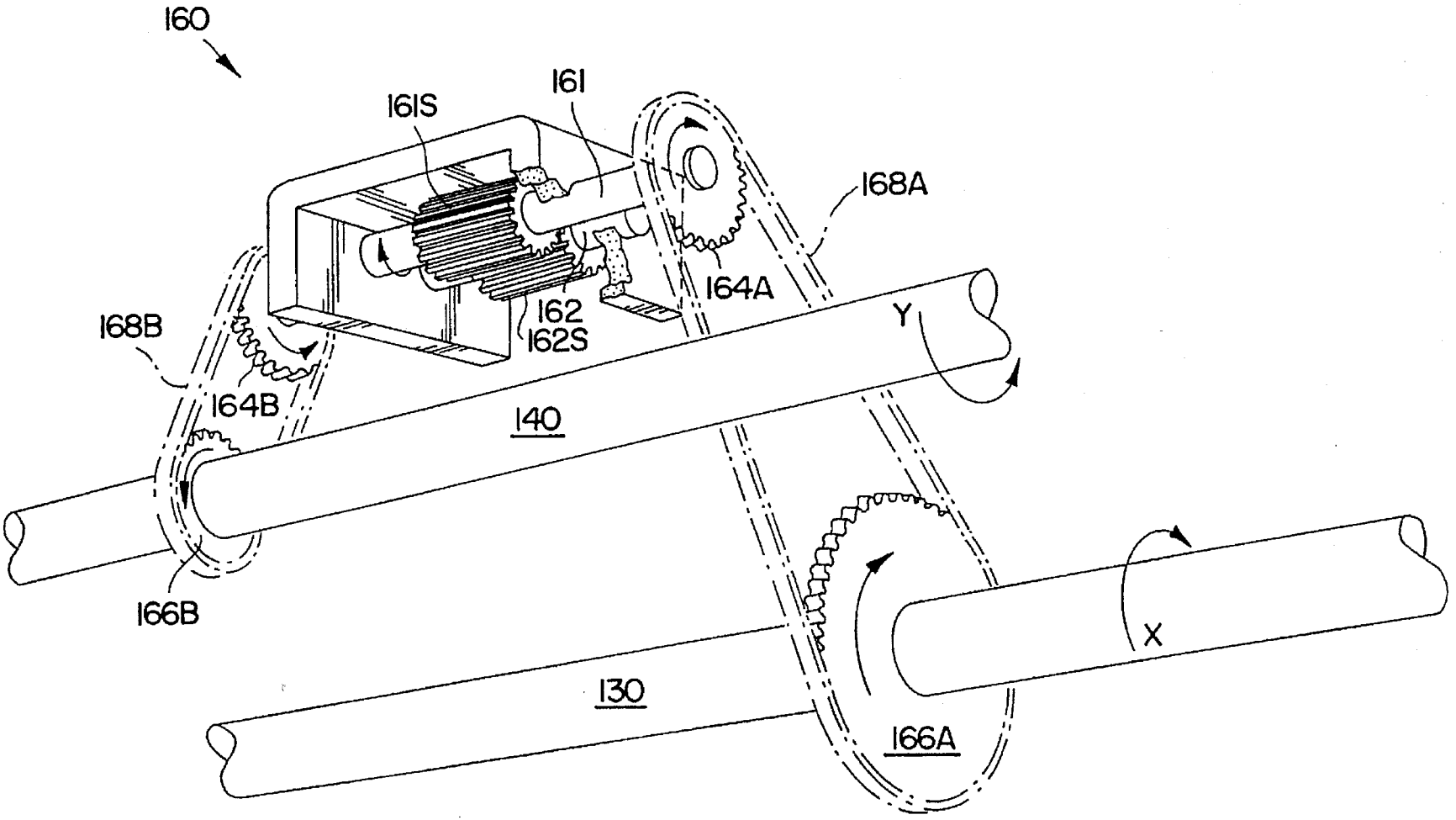
FIG. 8 is an enlarged view of the gear mechanism as can be seen at the top of the security window as shown in FIG. 3.

Specifically with regard to FIG. 8, in the preferred embodiment of security window be with first and second movable panels 30 and 40, safety mechanism 159 also includes gear mechanism 160, with a 2:1 gear ratio, which has a primary function to allow second movable panel 40 to move twice as far as first movable panel 30 during activation of security window 10.

More particularly, gear mechanism 160 interconnects first shaft 130 (which is associated with first movable panel 30) with second shaft 140 (which is associated with second movable panel 40) as follows. Gear mechanism 160 includes two rotatable shafts 161 and 162 with associated equal sized intermeshing spur gears 161S and 162S. Shaft 161 has mounted on one end sprocket 164A and shaft 162 has mounted on the opposite end sprocket 164B. Additionally, a first shaft sprocket 166A is provided on first shaft 130 and a second shaft sprocket 16B is provided on second shaft 140.

First shaft sprocket 166A on first shaft 130 is operatively connected with first gear sprocket 164A by way of first chain 168A being wound around the two sprockets. Likewise, second shaft sprocket 166B on second shaft 140 is operatively connected with second gear sprocket 164B by way of second chain 168B being wound around the two sprockets. As a result, attempted vertical upward manual movement of one or both of first and second movable panels 30 and 40 causes rotation of both of shafts 130 and 140 away from each other in the direction, respectively, of arrows X and Y (see FIG. 8), whereby chains 134A, 134B, 144A, and 144B lock in place since they cannot (1) buckle due to channels 174A, 174B and 184A, 184B; (2) lift off their respective sockets due to blocks 172A, 172B and 182A, 182B; or (3) move linearly due to ratchet 151 which locks under countertop T due to its spring loaded handle 151A (see FIG. 9).

Thus, if a would be robber attempts to pry up panel 40, safety mechanism of security window 10 functions as follows:

1. Raising panel 40 slightly upwardly causes chains 144A and 144B to move;
2. Because of chain guides 184A and 184B, the chain cannot buckle;
3. Because of blocks 182A and 182B, the chains cannot be lifted off sprockets 142A and 142B;
4. Thus, shaft 140 is caused to rotate;
5. Shaft 140 is interconnected with shaft 130 by means of gear box 160;

6. Therefore, any rotation of shaft 140 causes counter-rotation of shaft 130;
7. Rotation of shaft 130 causes a movement of chains 134A and 134B such that panel 30 will move in an upward direction and counterweight 90 moves down;
8. Sprocket 153 which engages chain 134A will be caused to rotate;
9. This rotation causes shaft 152 and ratchet 151 to rotate;
10. Ratchet 151 includes a spring loaded spinner handle 151A and locking pin 151B (see FIG. 9); and
11. Since ratchet and spinner handle assembly 151 is positioned in its inoperative mode with the locking pin 151B adjacent to the underside of countertop T, the rotating ratchet 151 will contact and lock against the underside of countertop T and prevent panels 30 and 40 from being forcibly raised.

Figure 9:
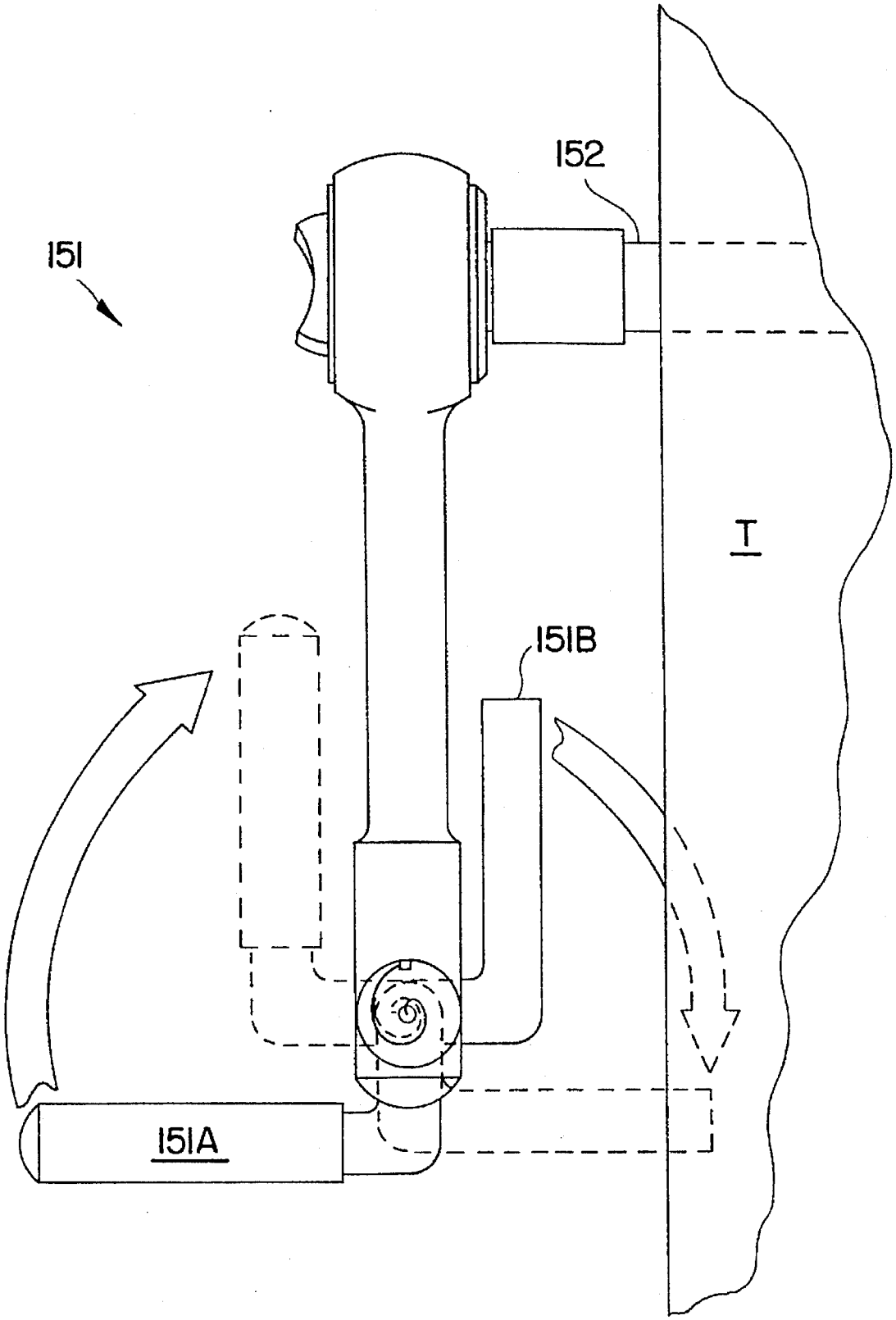
FIG. 9 is a top plan view of the ratchet actuator of the security window.

It will be understood and appreciated that when the operator manually cranks panels 30 and 40 up or down, he moves the spinner handle into position perpendicular to ratchet handle 151, as shown in FIG. 9. This causes the associated locking pin to be parallel to the ratchet and not to catch on countertop T when the entire assembly comprising spinner handle 151A, locking pin 151B, ratchet 151, shaft 152 and sprocket 153 is rotated. Once the operator releases spinner handle 151A, spring action urges the spinner handle to an operative position parallel and adjacent to ratchet 151 and this causes the locking pin 151B to protrude at ninety degrees (see FIG. 9) so as to engage the underside of countertop T if any further rotation of ratchet 151 occurs.

It will be understood that various details of the invention may be changed without departing from the scope of the invention. Furthermore, the foregoing description is for the purpose of illustration only, and not for the purpose of limitation—the invention being defined by the claims.

What is claimed is:

1. A security window comprising:

(a) a frame having a roof member, a first side member, a second side member, and a bottom member;

(b) a vertically extending panel fixedly mounted adjacent to the roof member, and the fixed panel having a top edge, a bottom edge, a first side edge, and a second side edge;

(c) a vertically extending movable panel assemblage comprising at least one movable panel slidably mounted in the frame and adapted to be vertically moved between an upper open position and a lower closed position, and the at least one movable panel having a top edge, a bottom edge, a first side edge, and a second side edge;

(d) a counterbalance for the movable panel assemblage including a primary counterweight having a first end and a second end, and being disposed in the bottom member of the frame;

(e) a mounting mechanism operatively associated with the frame to permit vertical movement of the at least one movable panel in a path that defines a plane substantially parallel to the plane defined by the fixed panel, the mounting mechanism including:

(i) a first shaft, having a first end and a second end, and the first shaft being operatively associated with the at least one movable panel and being supported for rotational movement adjacent the roof member of the frame;

(ii) a first and a second sprocket disposed, respectively, at the first end and the second end of the first shaft; and (iii) a first and a second chain connected, respectively, to the first and the second side edges of the at least one movable panel, and connected, respectively, to the first and the second ends of the primary counterweight, and wound, respectively over the first and the second sprockets;

(f) an activator operatively associated with the movable panel assemblage, such that engagement of the activator with the mounting mechanism allows for the vertical movement of the movable panel; and (g) a safety mechanism operatively associated with the movable panel assemblage and adapted to prevent direct vertical manual movement of the at least one movable panel.

2. The security window of claim 1 wherein the at least one movable panel and the fixed panel are provided with bullet-resistant characteristics.

3. The security window of claim 1 wherein each of the at least one movable panel and the fixed panel is manufactured from a transparent material, such that the transparent material provides bullet-resistant characteristics to the security window.

4. The security window of claim 1, wherein the frame is mounted on a countertop having a recess disposed therein beneath the at least one movable panel and the fixed panel, the recess being for passing items from one side to another side of the security window when the at least one movable panel is in the closed position.

5. The security window of claim 1, wherein the fixed panel and the at least one movable panel are in substantially parallel relationship when the at least one movable panel is in the open position, and are in substantially imbricated relationship when the at least one movable panel is in the closed position.

6. The security window of claim 5, wherein the imbricated relationship provides that the bottom edge of the fixed panel and the top edge of the at least one movable panel (i) overlap from about 1 inch (about 2.54 cm) to about 2 inches (about 5.08 cm) and (ii) are spaced apart from about 0.25 inch (about 0.635 cm) to about 0.50 inch (about 1.27 cm).

7. The security window of claim 1, wherein the activator comprises a ratchet for manual movement of the movable panel assemblage, said ratchet including a spring biased handle adapted to engage the underside of a countertop upon which said security window may be mounted.

8. The security window of claim 1, wherein the safety mechanism includes:

(i) a first channel for the first chain and a second channel for the second chain, with the first channel being disposed in the first side member and the second channel being disposed in the second side member, and each channel being dimensioned to permit respective travel therein of each associated chain freely about its associated sprocket but to prevent each chain from buckling during attempted direct vertical movement of the at least one movable panel; and (ii) a first and a second arcuate-shaped block respectively disposed in each of the first and the second side members, with the first and the second blocks being respectively positioned above each of the first and the second sprockets to prevent each of the first and the second chains from being lifted off its associated sprocket during attempted direct vertical manual movement of the at least one movable panel.

9. The security window of claim 1, wherein:

the at least one movable panel of the movable panel assemblage comprises a first movable panel and the movable panel assemblage further comprises a second vertically extending movable panel slidably mounted in the frame and adapted to be vertically moved between an upper open position and a lower closed position, and the second movable panel having a top edge, a bottom edge, a first side edge, and a second side edge;

the counterbalance further includes a secondary counterweight comprising a first and a second equally sized counterweight vertically disposed, respectively, in each of the first and the second side members of the frame; and the mounting mechanism further includes:

(i) a second shaft operatively associated with the second movable panel, the second shaft being supported for rotational movement adjacent the roof member and the second shaft having a first end and a second end;

(ii) a third and a fourth sprocket disposed, respectively, at the first end and the second end of the second shaft; and (iii) a third and a fourth chain connected, respectively, to the first and the second side edges of the second movable panel, and connected, respectively, to the first and the second equally sized secondary counterweights, and wound, respectively, over the third and the fourth sprockets.

10. The security window of claim 9, wherein:

the frame is mounted on a countertop;

each of the first and the second movable panels and the fixed panel are approximately the same size;

the first and the second movable panels, when in the open position, and the fixed panel are in substantially parallel relationship; and the first and the second movable panels, when in the closed position, and the fixed panel are in imbricated relationship such that:

(i) portions of the bottom edge of the first movable panel contact first and second stoppers disposed, respectively, in the first and the second side members approximately midway between the countertop and the bottom edge of the fixed panel, whereby the first movable panel is approximately midway between the fixed panel and the second movable panel, and (ii) the bottom edge of the second movable panel contacts the countertop.

11. The security window of claim 9, wherein the safety mechanism comprises:

(i) a first, a second, a third, and a fourth channel, respectively, for each of the first, second, third, and fourth chain, with the first and the third channels being disposed in the first side member of the frame and the second and the fourth channels being disposed in the second side member of the frame, and each channel being dimensioned to permit travel therein of each associated chain freely about its associated sprocket but to prevent each associated chain from buckling during attempted direct vertical manual movement of one or both of the first and the second movable panels; and (ii) a first, a second, a third, and a fourth arcuate-shaped block, with the first and the third blocks being disposed in the first side member of the frame and the second and the fourth blocks being disposed in the second side member of the frame, and each of the first, second, third, and fourth blocks being positioned, respectively, above each of the first, second, third, and fourth sprockets to prevent each associated chain from being lifted off its associated sprocket during attempted direct vertical manual movement of one or both of the first and the second movable panels.

12. A security window comprising:

(a) a frame having a roof member, a first side member, a second side member, and a bottom member;

(b) a vertically extending panel fixedly mounted adjacent to the roof member, and the fixed panel having a top edge, a bottom edge, a first side edge, and a second side edge;

(c) a vertically extending movable panel assemblage comprising at least one movable panel slidably mounted in the frame and adapted to be vertically moved between an upper open position in superposed registration with the fixed panel and a lower closed position vertically below the fixed panel, and the at least one movable panel having a top edge, a bottom edge, a first side edge, and a second side edge;

(d) a counterbalance for the movable panel assemblage including a primary counterweight disposed in the bottom member of the frame;

(e) a mounting mechanism operatively associated with the frame to permit vertical movement of the at least one movable panel in a path that defines a plane substantially parallel to the plane defined by the fixed panel, wherein:

the mounting mechanism includes:

(i) a first shaft, having a first end and a second end, and the first shaft being operatively associated with the at least one movable panel and being supported for rotational movement adjacent the roof member of the frame;

(ii) a first and a second sprocket disposed, respectively, at the first end and the second end of the first shaft; and (iii) a first and a second chain connected, respectively, to the first and the second side edges of the at least one movable panel, and connected to the primary counterweight, and wound, respectively, over the first and the second sprockets;

(f) an activator operatively associated with the movable panel assemblage, such that engagement of the activator with the mounting mechanism allows for vertical movement of the at least one movable panel; and (g) a safety mechanism operatively associated with the movable panel assemblage and adapted to prevent direct vertical manual movement of the at least one movable panel, wherein:

the safety mechanism includes:

(i) a first channel for the first chain and a second channel for the second chain, with the first channel being disposed in the first side member and the second channel being disposed in the second side member, and each channel being dimensioned to permit respective travel therein of each associated chain freely about its associated sprocket but to prevent each chain from buckling during attempted direct vertical manual movement of the movable panel; and (ii) a first and a second arcuate-shaped block respectively disposed in each of the first and the second side members, with the first and the second blocks being respectively positioned above each of the first and the second sprockets to prevent each of the first and the second chains from being lifted off its associated sprocket during attempted direct vertical manual movement of the at least one movable panel.

13. The security window of claim 12, wherein:

the at least one movable panel of the movable panel assemblage comprises a first movable panel and the movable panel assemblage further comprises a second vertically extending movable panel slidably mounted in the frame and adapted to be vertically moved between an upper open position and a lower closed position, and the second movable panel having a top edge, a bottom edge, a first side edge, and a second side edge;

the counterbalance further includes a secondary counterweight comprising a first and a second equally sized counterweight vertically disposed, respectively, in each of the first and the second side members of the frame; and the mounting mechanism further includes:

(i) a second shaft operatively associated with the second movable panel, the second shaft being supported for rotational movement adjacent the roof member and the second shaft having a first end and a second end;

(ii) a third and a fourth sprocket disposed, respectively, at the first end and the second end of the second shaft; and (iii) a third and a fourth chain connected, respectively, to the first and the second side edges of the second movable panel, and connected, respectively, to the first and the second equally sized secondary counterweights, and wound, respectively, over the third and the fourth sprockets.

14. The security window of claim 13, wherein:

the frame is mounted on a countertop;

each of the first and the second movable panels and the fixed panel are approximately the same size;

the first and the second movable panels, when in the open position, and the fixed panel are in substantially parallel relationship; and the first and the second movable panels, when in the closed position, and the fixed panel are in imbricated relationship such that:

(i) portions of the bottom edge of the first movable panel contact first and second stoppers disposed, respectively, in the first and the second side members approximately midway between the countertop and the bottom edge of the fixed panel, whereby the first movable panel is approximately midway between the fixed panel and the second movable panel, and (ii) the bottom edge of the second movable panel contacts the countertop.

15. The security window of claim 13, wherein the safety mechanism comprises:

(i) a first, a second, a third, and a fourth channel, respectively, for each of the first, second, third, and fourth chains, with the first and the third channels being disposed in the first side member of the frame and the second and the fourth channels being disposed in the second side member of the frame, and each channel being dimensioned to permit travel therein of each associated chain freely about its associated sprocket but to prevent each associated chain from buckling during attempted direct vertical manual movement of one or both of the first and the second movable panels; and (ii) a first, a second, a third, and a fourth arcuate-shaped block, with the first and the third blocks being disposed in the first side member of the frame and the second and the fourth blocks being disposed in the second side member of the frame, and each of the first, second, third, and fourth blocks being positioned, respectively, above each of the first, second, third, and fourth sprockets to prevent each associated chain from being lifted off its associated sprocket during attempted direct vertical manual movement of one or both of the first and the second movable panels.

16. The security window of claim 12, wherein the at least one movable panel and the fixed panel are provided with bullet-resistant characteristics.

17. The security window of claim 16, wherein each of the at least one movable panel and the fixed panel is manufactured from a transparent material, such that the transparent material provides bullet-resistant characteristics to the security window.

18. The security window of claim 12, wherein the frame is mounted on a countertop having a recess disposed therein beneath the at least one movable panel and the fixed panel, the recess being for passing items from one side to another side of the security window when the at least one movable panel is in the closed position.

19. The security window of claim 12, wherein the fixed panel and the at least one movable panel are in substantially parallel relationship when the at least one movable panel is in the open position, and are in substantially imbricated relationship when the at least one movable panel is in the closed position.

20. The security window of claim 12, wherein the activator comprises a ratchet for manual movement of the movable panel assemblage.

* * * * *